US006969042B2

(12) United States Patent
Gaydos

(10) Patent No.: US 6,969,042 B2
(45) Date of Patent: Nov. 29, 2005

(54) BLOWOUT PREVENTER AND RAM ACTUATOR

(75) Inventor: Stephen Thomas Gaydos, Houston, TX (US)

(73) Assignee: Varco I/P, Inc., Houston, TX (US)

( * ) Notice: Subject to any disclaimer, the term of this patent is extended or adjusted under 35 U.S.C. 154(b) by 0 days.

(21) Appl. No.: 10/837,502

(22) Filed: May 1, 2004

(65) Prior Publication Data

US 2005/0242308 A1 Nov. 3, 2005

(51) Int. Cl.[7] ..... E21B 33/06
(52) U.S. Cl. ..... 251/1.3; 251/1.1
(58) Field of Search ..... 251/1.1, 1.2, 1.3

(56) References Cited

U.S. PATENT DOCUMENTS

| | | | | |
|---|---|---|---|---|
| 1,854,058 | A | 4/1932 | Otis | |
| 1,875,673 | A | 9/1932 | Stockstill | |
| 1,949,672 | A | 3/1934 | Barrier | |
| 2,645,450 | A | 7/1953 | Chessman | |
| 2,752,119 | A | 6/1956 | Allen et al. | |
| 2,986,367 | A | 5/1961 | Rouax | |
| 3,036,807 | A | 5/1962 | Lucky et al. | |
| 3,050,943 | A | 8/1962 | Thorel et al. | |
| 3,095,176 | A | 6/1963 | Hunt | |
| 3,242,826 | A | 3/1966 | Smith | |
| 3,272,222 | A | 9/1966 | Allen | |
| 3,416,767 | A | 12/1968 | Blagg | |
| 3,434,729 | A | 3/1969 | Shaffer et al. | 277/181 |
| 3,561,526 | A | 2/1971 | Williams, Jr. | 166/55 |
| 3,580,286 | A | 5/1971 | Bash | 137/625.68 |
| 3,590,920 | A | 7/1971 | Oruna et al. | 166/55 |
| 3,744,749 | A | 7/1973 | LeRouax | 251/1 |
| 3,791,616 | A | 2/1974 | LeRouax | 251/1 |
| 3,871,613 | A | 3/1975 | LeRouax | 251/1 |
| 3,918,478 | A | 11/1975 | LeRouax | 137/315 |
| 3,921,660 | A | 11/1975 | Kowalski | 137/236 |
| 3,933,338 | A | 1/1976 | Herd et al. | 251/63.6 |
| 3,941,141 | A | 3/1976 | Robert | 137/1 |
| 4,011,892 | A | 3/1977 | Kowalski | 137/625.66 |
| 4,052,995 | A | 10/1977 | Ellison | 137/1 |
| 4,076,208 | A | 2/1978 | Olson | 251/1 |
| 4,167,262 | A | 9/1979 | Lemmon | 251/25 |
| 4,188,860 | A | 2/1980 | Miller | 92/15 |
| 4,214,605 | A | 7/1980 | Hardgrave | 137/495 |

(Continued)

OTHER PUBLICATIONS

MPL Components. MPL Automatic Ram Locking. Hydril Mechanical Products Division. 2 pp. published Nov. 19, 1996 with U.S. Patent 5.575.452.

(Continued)

*Primary Examiner*—J. Casimer Jacyna
(74) *Attorney, Agent, or Firm*—Guy McClung

(57) ABSTRACT

A blowout preventer with a main body; a base releasably connected to the main body, the base having a base space therein, the base having a ram shaft opening; a primary piston movably disposed within the base space; a ram shaft to which the primary piston is connected, the ram shaft including a ram end and a piston end; a ram connected to the ram end of the ram shaft; a housing connected to the base, the housing having a housing space therein, the housing including a middle member with a member opening; a booster piston movably disposed within the housing space and having a booster shaft projecting therefrom and a booster shaft space therein; the shaft including a push portion selectively movable to abut the ram shaft to prevent movement of the ram shaft and to transfer force of the booster piston to the primary piston; and power fluid apparatus for the primary piston and the booster piston.

20 Claims, 14 Drawing Sheets

U.S. PATENT DOCUMENTS

| | | | | |
|---|---|---|---|---|
| 4,253,638 | A | 3/1981 | Troxell, Jr. | 251/1 A |
| 4,290,577 | A | 9/1981 | Olson | 251/1 |
| 4,305,565 | A | 12/1981 | Abbe | 251/1 |
| 4,313,496 | A | 2/1982 | Childs et al. | 166/55 |
| 4,347,898 | A | 9/1982 | Jones | 166/55 |
| 4,488,703 | A | 12/1984 | Jones | 251/77 |
| 4,491,155 | A | 1/1985 | Meyer et al. | 137/625.66 |
| 4,502,534 | A | 3/1985 | Roche et al. | 166/84 |
| 4,504,037 | A | 3/1985 | Beam et al. | 251/1 |
| 4,508,313 | A | 4/1985 | Jones | 251/1 A |
| 4,519,571 | A | 5/1985 | Jones et al. | 251/1 |
| 4,519,577 | A | 5/1985 | Jones | 251/62 |
| 4,523,639 | A | 6/1985 | Howard, Jr. | 166/55 |
| 4,558,842 | A | 12/1985 | Peil et al. | 251/1.3 |
| 4,580,626 | A | 4/1986 | Jones | 166/55 |
| 4,582,293 | A | 4/1986 | Jones | 251/1.3 |
| 4,589,625 | A | 5/1986 | Jones | 251/1.3 |
| 4,601,232 | A | 7/1986 | Troxell, Jr. | 92/24 |
| 4,638,972 | A | 1/1987 | Jones et al. | 251/1.3 |
| 4,864,914 | A | 9/1989 | LeMoine | 91/29 |
| 4,877,217 | A | 10/1989 | Peil et al. | 251/1.3 |
| 4,887,643 | A | 12/1989 | Tomlin et al. | 137/625.66 |
| 4,923,008 | A | 5/1990 | Wachowicz et al. | 166/250 |
| 4,943,031 | A | 7/1990 | Van Winkle | 251/1.3 |
| 4,969,390 | A | 11/1990 | Williams, III | 92/28 |
| 4,969,627 | A | 11/1990 | Williams, III | 251/1.3 |
| 5,025,708 | A | 6/1991 | Smith et al. | 92/19 |
| 5,056,418 | A | 10/1991 | Granger et al. | 92/24 |
| 5,199,683 | A | 4/1993 | Le | 251/1.3 |
| 5,255,890 | A | 10/1993 | Morrill | 251/1.3 |
| 5,287,879 | A | 2/1994 | Leggett et al. | 137/246.22 |
| 5,320,325 | A | 6/1994 | Young et al. | 251/1.3 |
| 5,400,857 | A | 3/1995 | Whitby et al. | 166/297 |
| 5,505,426 | A | 4/1996 | Whitby et al. | 251/1.3 |
| 5,575,452 | A | 11/1996 | Whitby et al. | 251/1.3 |
| 5,588,491 | A | 12/1996 | Brugman et al. | 166/383 |
| 5,653,418 | A | 8/1997 | Olson | 251/1.3 |
| 5,662,171 | A | 9/1997 | Brugman et al. | 166/383 |
| 5,735,502 | A | 4/1998 | Levett et al. | 251/1.3 |
| 5,778,918 | A | 7/1998 | McLelland | 137/15 |
| 5,897,094 | A | 4/1999 | Brugman et al. | 251/1.3 |
| 5,918,851 | A | 7/1999 | Whitby | 251/1.3 |
| 5,975,484 | A | 11/1999 | Brugman et al. | 251/1.3 |
| 6,244,560 | B1 | 6/2001 | Johnson | 251/1.3 |
| 6,276,450 | B1 | 8/2001 | Seneviratne | 166/85.1 |
| 6,374,925 | B1 | 4/2002 | Elkins et al. | 175/25 |
| 6,769,350 | B2 | 8/2004 | Hoogen et al. | 92/51 |
| 2004/0021269 | A1 | 2/2004 | Gaudette et al. | 277/325 |
| 2004/0084644 | A1 | 5/2004 | Wiedemann | 251/1.3 |
| 2004/0222393 | A1 | 11/2004 | Kinder | 251/1.3 |

OTHER PUBLICATIONS

NXT BOP System. Shaffer. Varco. 6 pp. 2001.

10
42
43
40
11
17b
14b
17b
61
14
92
16
20
60
40a
20a
17a
40b
91
17a
21
50
13k
41
13c
13
22
40f
93
15
18b
30
71
72
40d
90
40c
40d
18h
70
12i
12
19a
18d
18f
12a
18a
18c
18g
19
18a
80
T 11
40
10
14b
14
60a
17a
92
20
60
91
16
12g
50
13
12e
30
12
12f
90
70
12d
19
19a 11
40a
14b
14
92
61
16
20
60
40
20a
40b
91
22
50
12h
41
12g
13
40f
93
12e
15
72
30
40d
12b
OPEN
90
CLOSED
40c
40d
12d
12a
19a
12f
12c
19
80
11a 11
14
20
91
50
13
12e
30
90
19
70

BLOWOUT PREVENTER AND RAM ACTUATOR

BACKGROUND OF THE INVENTION

1. Field of the Invention

The present invention is directed to blowout preventers, to actuators for blowout preventer rams, and to methods of their use.

2. Description of Related Art

In a variety of situations, blowout preventers are used to control sub-surface pressures that may adversely affect equipment used in drilling oil and gas wells. Manual mechanisms and pneumatic or hydraulic pressure are employed to act on a piston to close or open ram sealing elements. Often hydraulic actuation is used when the required closing forces are relatively high. Hydraulic actuation force is applied to a cylinder containing a piston which in turn acts on a shaft having a ram element connected thereto. A closing force in such an apparatus may be substantially equivalent to the effective cross-sectional area of the piston multiplied by the pressure of the hydraulic fluid.

In a variety of prior art blowout preventers an enhanced closing force is applied to rams that are part of the blowout preventer, e.g., shear rams for shearing and closing off a tubular. In some prior art systems to achieve a desired closing force an hydraulic booster increases the effective closing force for a given hydraulic actuation pressure. In certain prior art systems, an hydraulic booster piston is placed in series with a main actuator piston and often the hydraulic booster provides a piston which has a larger cross-sectional area upon which the hydraulic pressure acts, thereby increasing the closing force. In one aspect a booster piston is attached to a far end of a guide rod and the near end of the guide rod acts on a high pressure side of the main actuator piston. A net closing force on the primary piston shaft is increased by the mechanical force to the main actuator piston resulting from hydraulic pressure to the booster piston. On some prior art systems the additive force of a booster or secondary piston on a primary piston will produce a total force that exceeds the strength of material of a ram block, resulting in the yielding or bending of the material. e.g. material of the wall on either side of a top seal vertical leg component.

U.S. Pat. No. 5,575,452 discloses, inter alia, a blowout preventer ram actuator mechanism with a primary piston including an outer sleeve portion which supports an independently movable locking piston which has tapered surfaces, and locking segments each engage one of a plurality of tapered locking rods fixed to the actuating mechanism housing. Since locking piston components move independently of the primary piston, an axially centered boosting force may not be exerted directly against internal moving parts without risking premature locking of the primary piston.

U.S. Pat. No. 6,244,560, co-owned with the present invention, discloses, inter alia, blowout preventer ram actuating mechanisms that include an hydraulic booster for enhancing the ram closing force. The ram actuating mechanism may be compatible for use with primary pistons which include internal moving components, such as self locking pistons. The ram actuating mechanism provide an hydraulic booster without increasing the diameter of the booster pistons above the diameter of the primary piston, so that stack height need not be increased to accommodate a relatively large diameter hydraulic booster. The ram actuating mechanism may utilize the same piston housing as used by the primary piston, and the booster pistons may act mechanically in series upon the primary piston to increase axial ram closing force.

The present inventor has recognized that there is a need to reduce the overall space and volume required by a blowout preventer and to reduce the weight of blowout preventers; but it is also necessary that a blowout preventer develop sufficient force on its rams to shear a tubular about which it is positioned. The present inventor has also recognized that it is also desirable in some circumstances to relieve or reduce the force on blowout preventer rams to reduce the pressure that is initially applied to the ram bodies and to their seals by a dual-piston actuator in order to prolong seal life and/or prevent deformation of ram blocks. The present inventor has also recognized that, in reducing the pressure on the closed rams, the requirement remains to positively maintain the rams in a closed position.

SUMMARY OF THE PRESENT INVENTION

The present invention, in certain aspects, teaches a ram-type blowout preventer with rams actuated by dual-piston actuators. A dual piston actuator according to the present invention, has, in certain aspects, housings in which a primary piston and a booster piston are simultaneously movable to move a ram shaft which in turn moves a ram of the blowout preventer. In one particular aspect the pistons are located, sized, and configured so that, upon movement and closure of the rams, the force of the booster piston on the rams is eliminated by limiting the booster piston's travel when the primary piston is near full stroke travel. To maintain the rams in a closed position while the force of the booster position on the rams has been eliminated, a movable locking member within and extending through a bore of the booster piston is selectively movable to abut an end of the ram shaft to mechanically maintain the ram shaft and its associated ram in a ram-closed position.

In certain aspects the locking member is operable by turning an exterior shaft extension projecting from the blowout preventer. Alternatively the locking member is movable automatically, e.g. using known automatic operator apparatus, e.g., but not limited to known POSLOCK (TM) apparatus available from Varco Shaffer.

In certain embodiments with the rams of such a blowout preventer mechanically locked in place, the booster piston can move to its initial pre-activation position within the housing so that its force is not applied to the lock rod while the lock rod maintains the rams in a closed position. Thus, if the blowout preventer is inadvertently opened (i.e. an operator inadvertently operates the blowout preventer to retract the rams), the booster piston begins to move and is allowed to move all the way back to its initial position and its force is not applied to the lock rod. If, upon such inadvertent opening, the force of both pistons was applied to the lockrod, the lock rod could bend preventing unlocking of the blowout preventer and opening of the rams and requiring expensive repairs.

It is, therefore, an object of at least certain preferred embodiments of the present invention to provide:

New, useful, unique, efficient, non-obvious blowout preventers, ram actuators for blowout preventers, and methods of their use;

Such blowout preventers with ram actuators having dual pistons and apparatus for selectively eliminating the force of one of the pistons on a ram shaft whose movement effects ram closure;

Such blowout preventers with such actuators having mechanical apparatus for maintaining rams in a closed position whether or not force is applied by the piston(s);

Such blowout preventers with such actuators which eliminate the force of a booster piston on rams so that pressure on ram seals and/or parts of ram blocks and/or ram block faces is reduced and/or damage to a lock rod is inhibited; and New, useful, unique, efficient, and nonobvious blowout preventers which provide sufficient force to close rams therein, shearing a tubular around which the blowout preventer, yet which, compared to certain previous apparatuses, are relatively smaller and weigh relatively less.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of certain embodiments of the invention may be had by references to the embodiments which are shown in the drawings which form a part of this specification.

FIGS. 1D and 1E, like FIG. 1, show various fluid flow routes through the actuator of FIG. 1.

DESCRIPTION OF EMBODIMENTS PREFERRED AT THE TIME OF FILING FOR THIS PATENT

Figure 1:
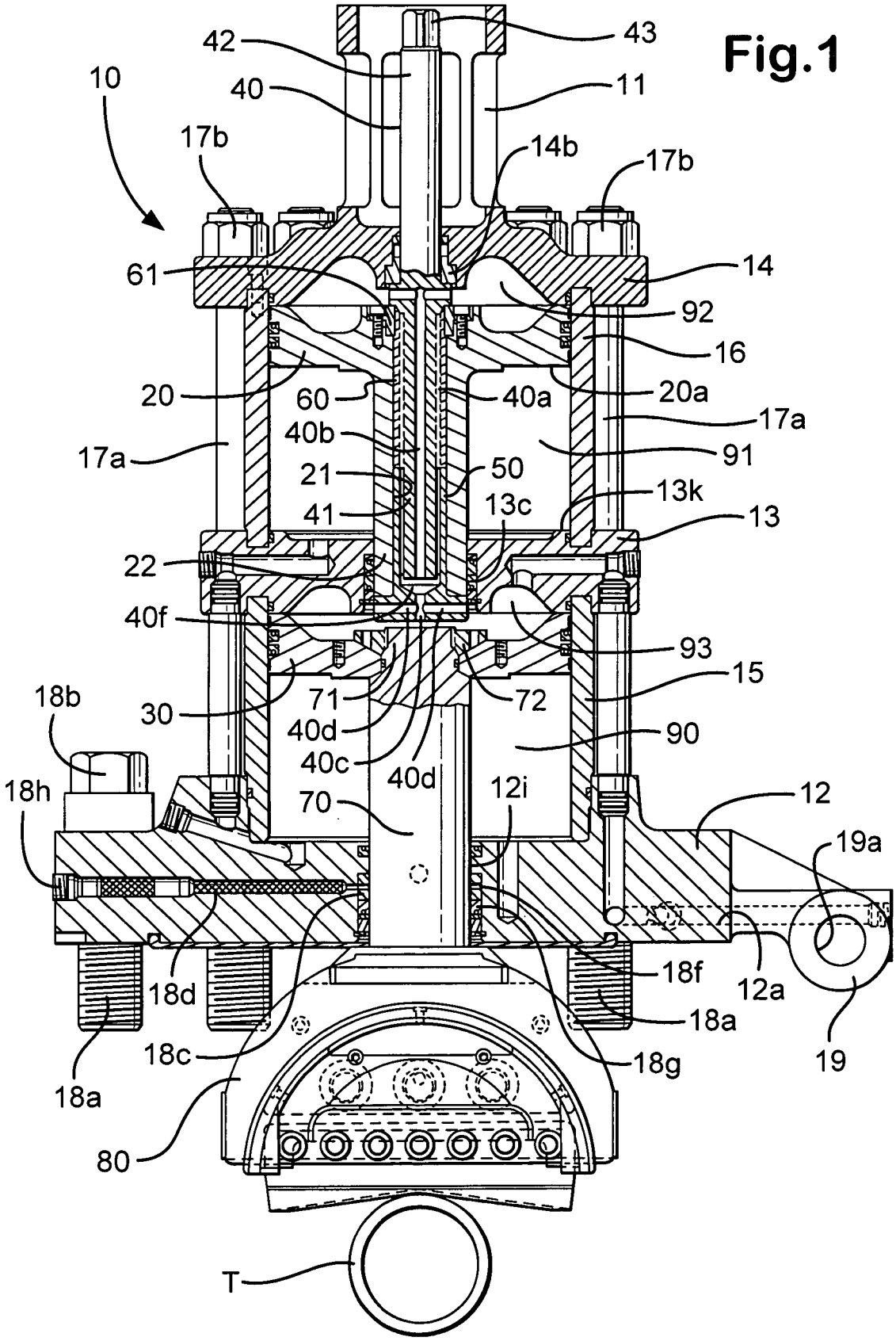
FIG. 1 is a cross-section view of a ram shaft actuator according to the present invention.

FIG. 1 shows an actuator 10 for a ram 80 of a ram-type blowout preventer (e.g. a blowout preventer as shown in FIG. 3) used with a tubular T. A base (or door) 12 is connected to a blowout preventer body with bolts 18*a* and nuts 18*b*. Optionally, the base 12 (and hence the actuator 10) is pivotally mounted to the blowout preventer using a pivot assembly 19 movably secured with a pin (not shown) through a hole 19*a*. A primary housing 15 with a generally cylindrical hollow shape supports a middle plate 13 that closes off the top of the primary housing 15. A secondary housing 16 with a generally cylindrical hollow shape supports a cylinder head 14 that closes off the top of the upper housing 16.

A primary piston 30 is movably situated in the primary housing 15. An end 71 of a ram shaft 70 is secured to the primary piston 30 with a lock nut 72. Movement of the primary piston 30 moves the ram shaft 70 and a ram 80 connected thereto. The ram shaft 70 moves in a bore 12*i* of the base 12.

A booster piston 20 movably situated in the secondary housing 16 has an end 22 which is movable in and through a bore 13*c* of the middle plate 13. A push piston 50 is free floating and movably mounted in a bore 21 of the booster piston 20. A lock sleeve 60 (interiorly threaded) is positioned and free to move within the bore 21 initially with an end adjacent an end of the push piston 50. A lock rod 40 has an end 41 within the push piston 50 and an end 42 which projects out from the top plate 14. Optionally, the end 42 has a square or hex shaped portion 43 for coaction with a wrench to move the lock rod 40.

A brass bushing 18*c* surrounds the ram shaft 70 and acts as a back up to a seal 18*g*. Injectable sealant (e.g. any known suitable injectable sealing material, including, but not limited to, injectable plastic) is injectable through an injection port 18*d* through ports 18*f* through the brass bushing 18*c*. A set screw 18*h* holds sealant in the injection port which sealant flows around the shaft 70. The lock rod 40 has exterior threads 40*a* for threaded mating with the threads of the lock sleeve 60.

A space 90 is within the primary housing 15; a space 91 is within the secondary housing 16; a space 93 is within the middle plate 13; and a space 92 is within the top plate 14. Hydraulic fluid under pressure for moving the pistons 20, 30, and 50 is provided by an hydraulic fluid pressure source 11*a*.

Figure 1A:
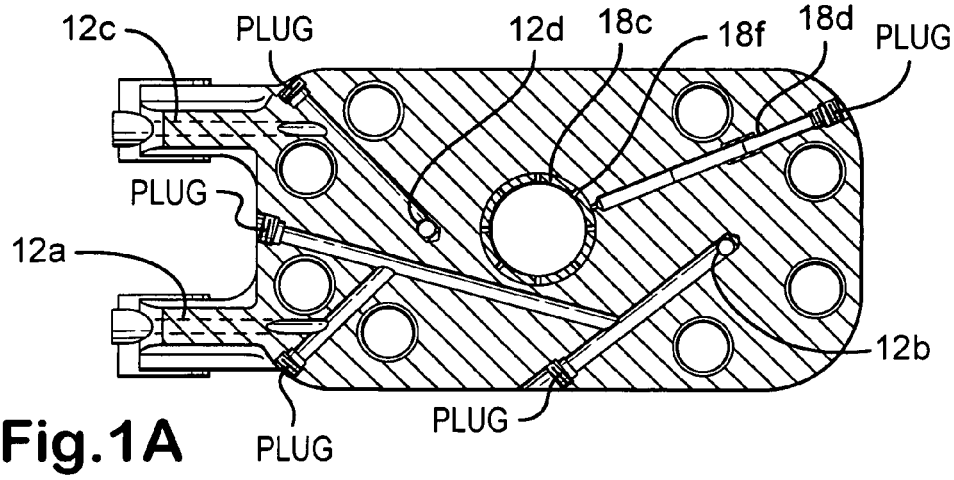
FIGS. 1A–1E are cross-section views of various portions of the actuator of FIG. 1.
Figure 1B:
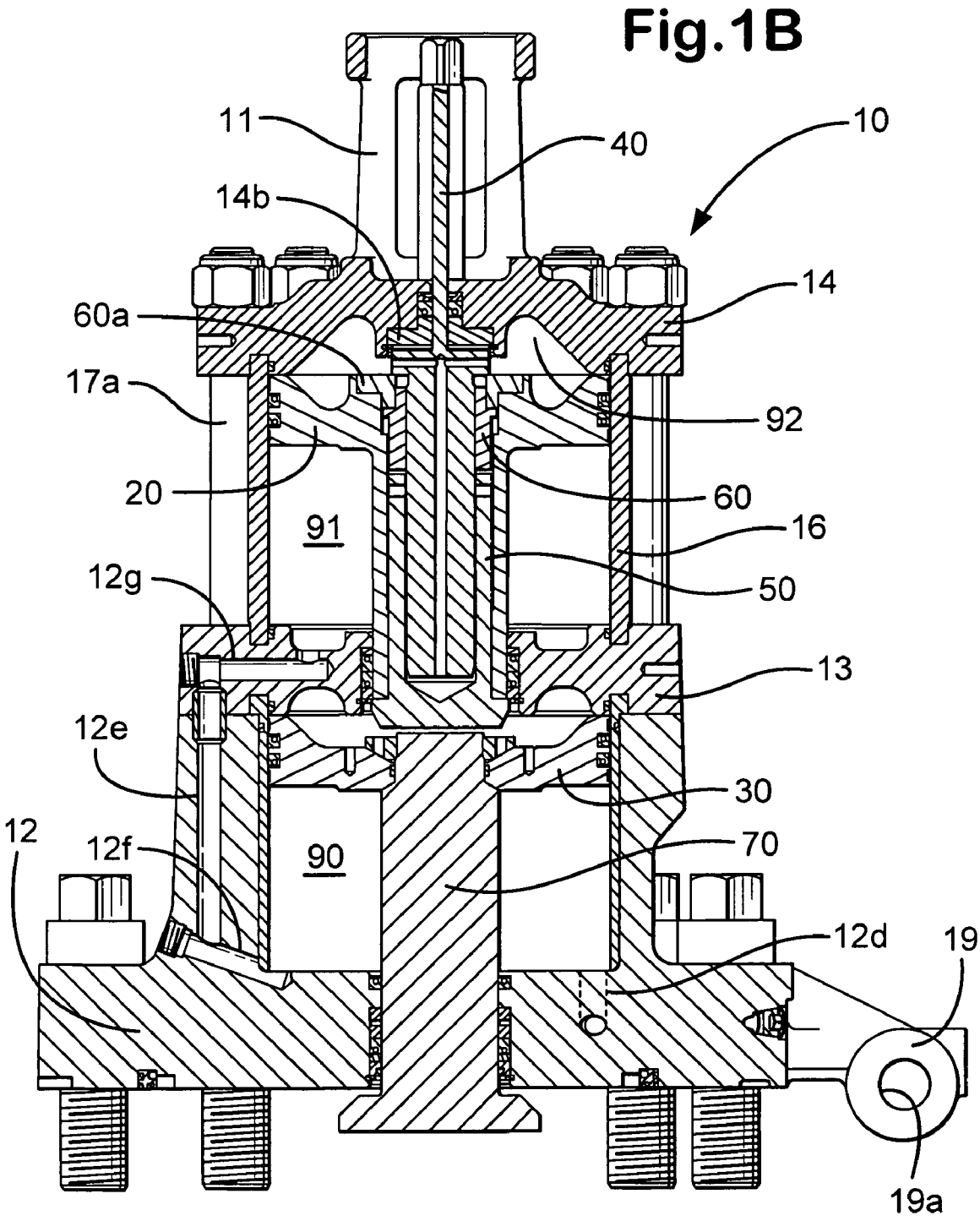
Figure 1C:
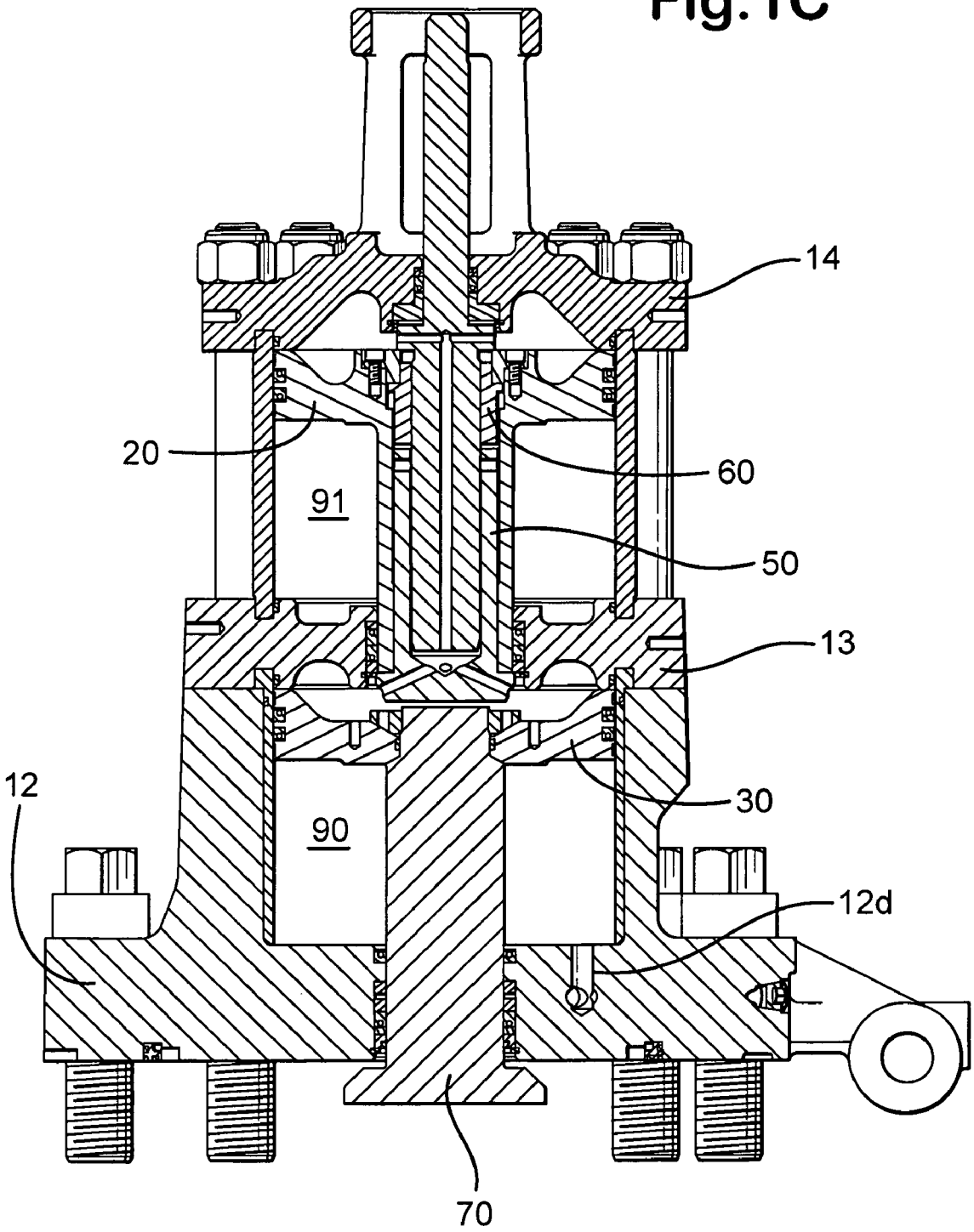
Figure 1D:
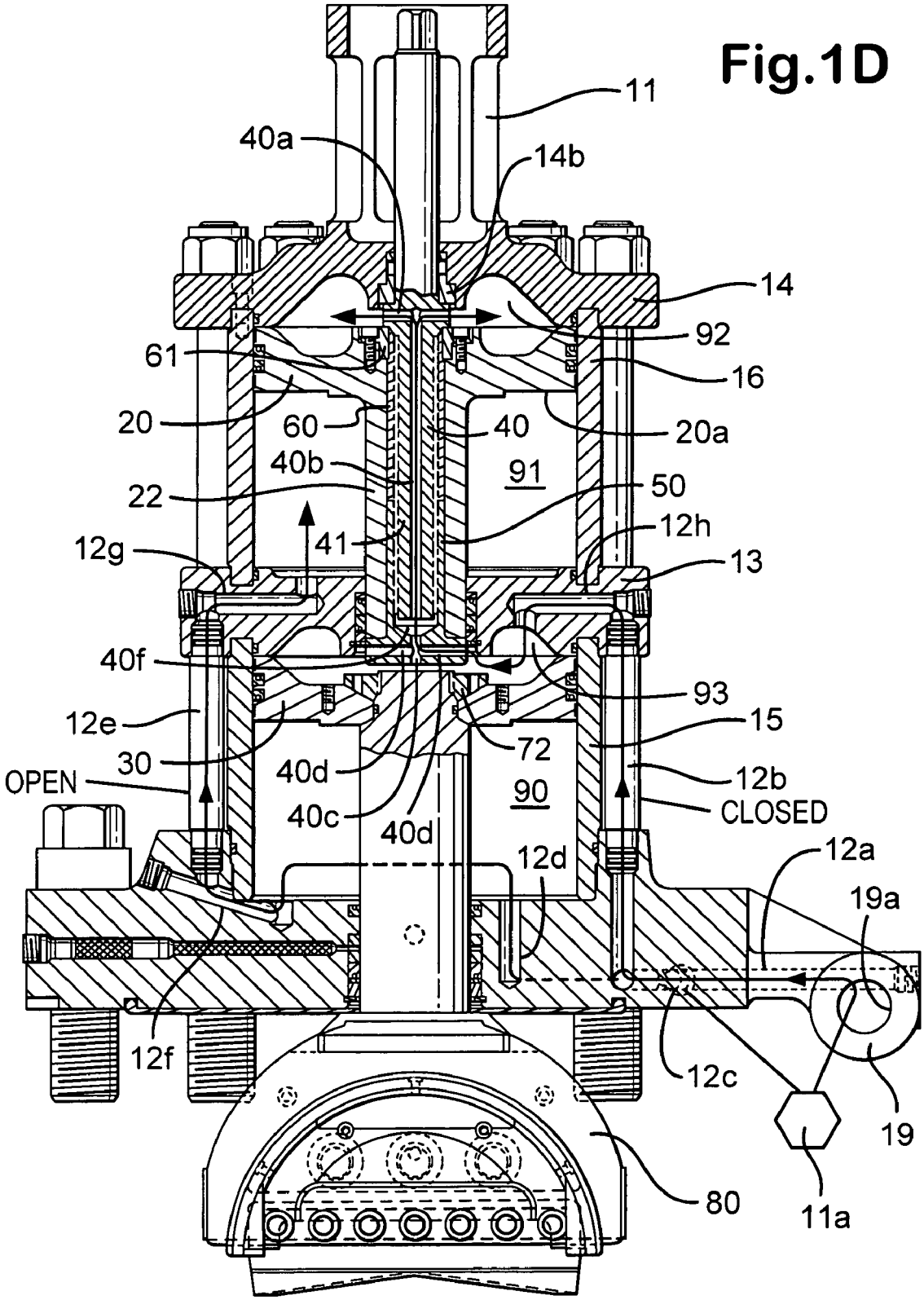
Figure 1E:
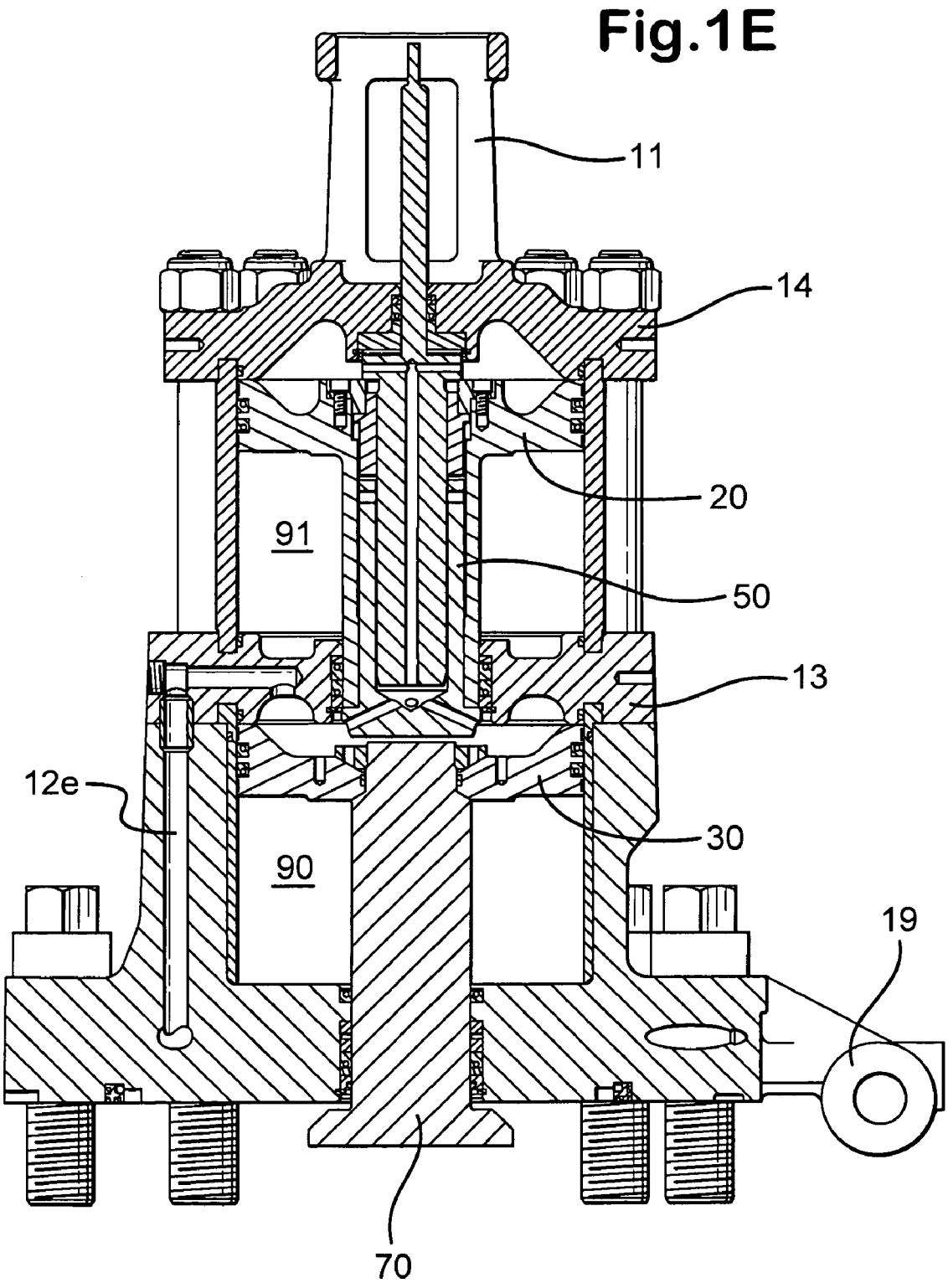

As shown in FIGS. 1, 1C and 1E to close the rams 80 (one shown;; one opposing ram, not shown, opposite the one shown with the same actuator apparatus) fluid under pressure from the source 11*a* flows through the channels 12*a*, 12*b*, 12*h* into the space 93, pushing the primary piston 30 and moving the ram shaft 70. From the space 93, the fluid also flows through channels 40*c*, 40*d*, 40*b*, 40*a* into the space 92, pushing the booster piston 20. The booster piston 20 moves to contact the ram shaft 70 and the force of the booster piston 20 is added to the force of the primary piston 30 to move the ram shaft 70 and its ram 80.

To open the rams 80, fluid from the source 11*a* flows in the channels 12*c*, 12*d* into the space 90, pushing the primary piston 30 toward the plate 13 moving the ram shaft 70 and the ram 80 away from a tubular T. Fluid also flows from the space 90 through the channels 12*f*, 12*e*, and 12*g* into the space 91, moving the booster piston 20 toward the cylinder head 14 so that the shaft 20*a* of booster piston 20 does not impede movement of the primary piston 30.

The closing speed of the two pistons 20, 30 is equalized by permitting fluid to flow through the channel 40*b* and from the channel 12*d* into a space 40*f* between the lock rod 40 and the push piston 50 and lock sleeve 60. This fluid flows out from the space 40*f* and onto the top side of the booster piston 20 (thus moving the booster piston 20 at the same rate as the primary piston 30 so the combined force of both pistons is continuously applied in one smooth stroke. Desirably, fluid flow through the channel 12*c* is equalized by fluid flow through the channels 40*d* and 40*b* and the space 40*f*. With the free floating piston 50, the lock sleeve 60, the lock rod 40 (threaded into the lock sleeve 60) and the anti-rotation plate 61 (restraining the lock sleeve 60's axial movement) all located within the booster piston 20, when the booster piston 20 stops short of the primary piston 30 at full stroke, there still is a rigid lock between the ram shaft 70 and the thrust bushing 14*b* (the lock including the booster piston 20, the lock rod 40 and the lock sleeve 60). This locking is achieved with the lock rod 40 independent of the ram shaft 70 and of the primary piston 30.

Figure 2A:
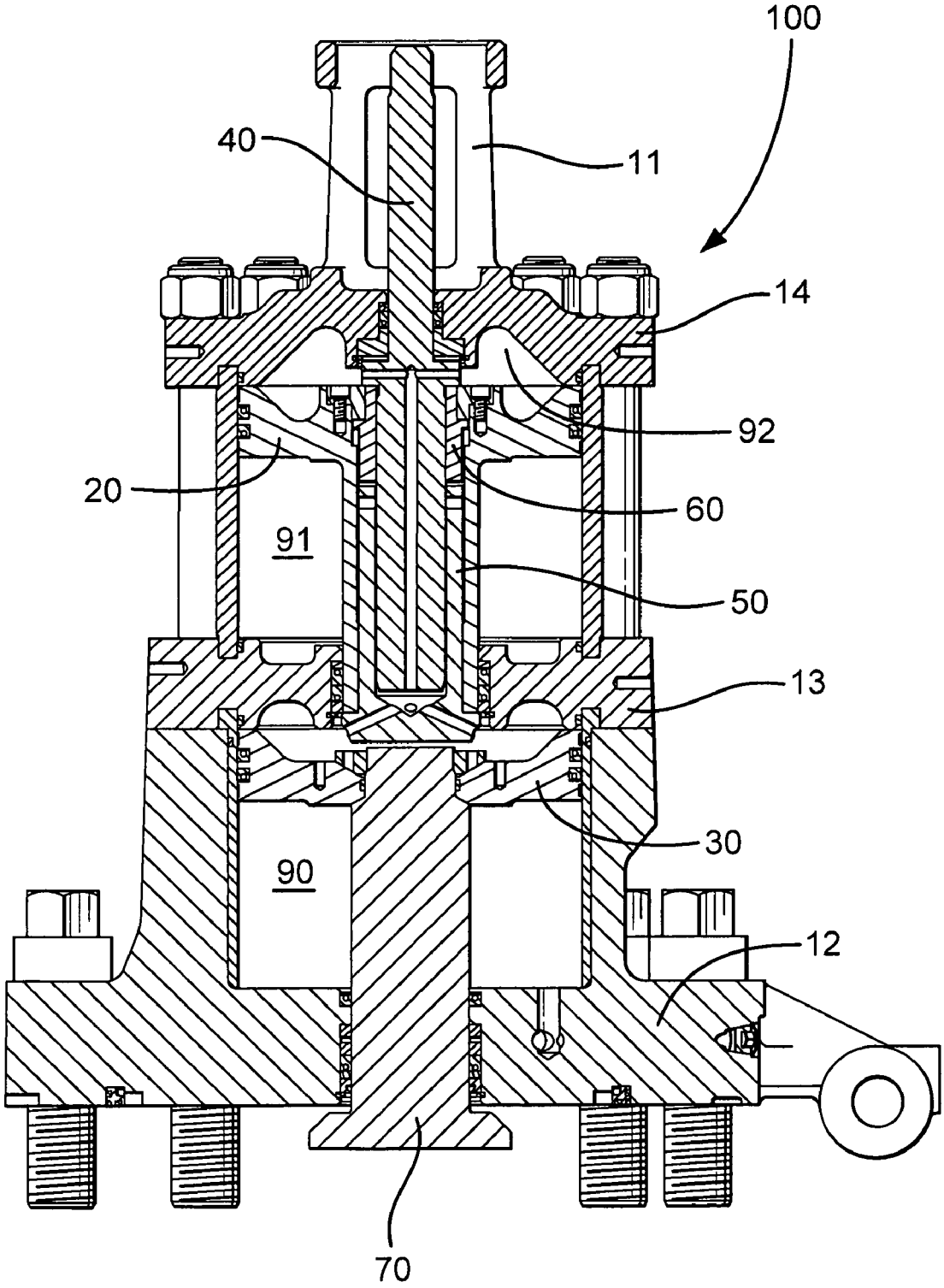
FIGS. 2A–2G are cross-section views showing steps in operation of a ram shaft actuator according to the present invention.
Figure 2B:
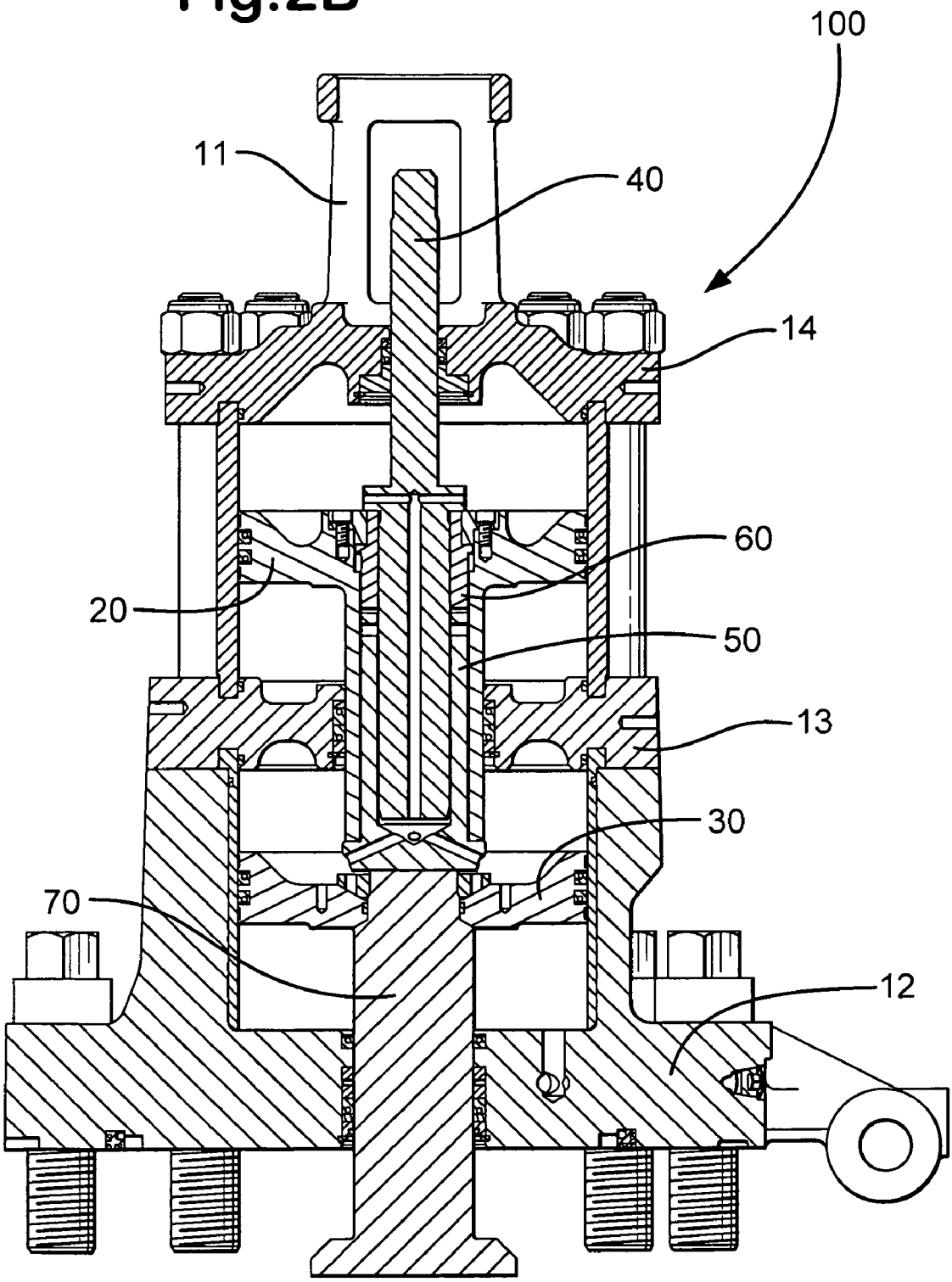

FIGS. 2A–2G show operation of an actuator 100 (like the actuator 10 described above; like numerals indicate like parts). In FIG. 2A pistons 20, 30 and 50 are in initial positions, as are the lock sleeve 60 and the ram shaft 70. The lock sleeve 60, optionally with a shearable lip 60*a*, has an anti-rotation plate 61 that initially restrains the lock sleeve 60 preventing its rotation and, thereby, rotation of the booster piston. The lock rod 40 is also in its initial position. A ram attached to the ram shaft 70 has not yet been moved.

Pressurized hydraulic fluid enters into the space 90 and flows into spaces 92 and 93.

The primary piston 30 (FIG. 2B) starts to move, moving the ram shaft 70 and initiating cutting of a tubular (e.g. tubular T, FIG. 1). The booster piston 20 follows adding its force (through the push piston 50) to the force of the primary piston 20.

Figure 2C:
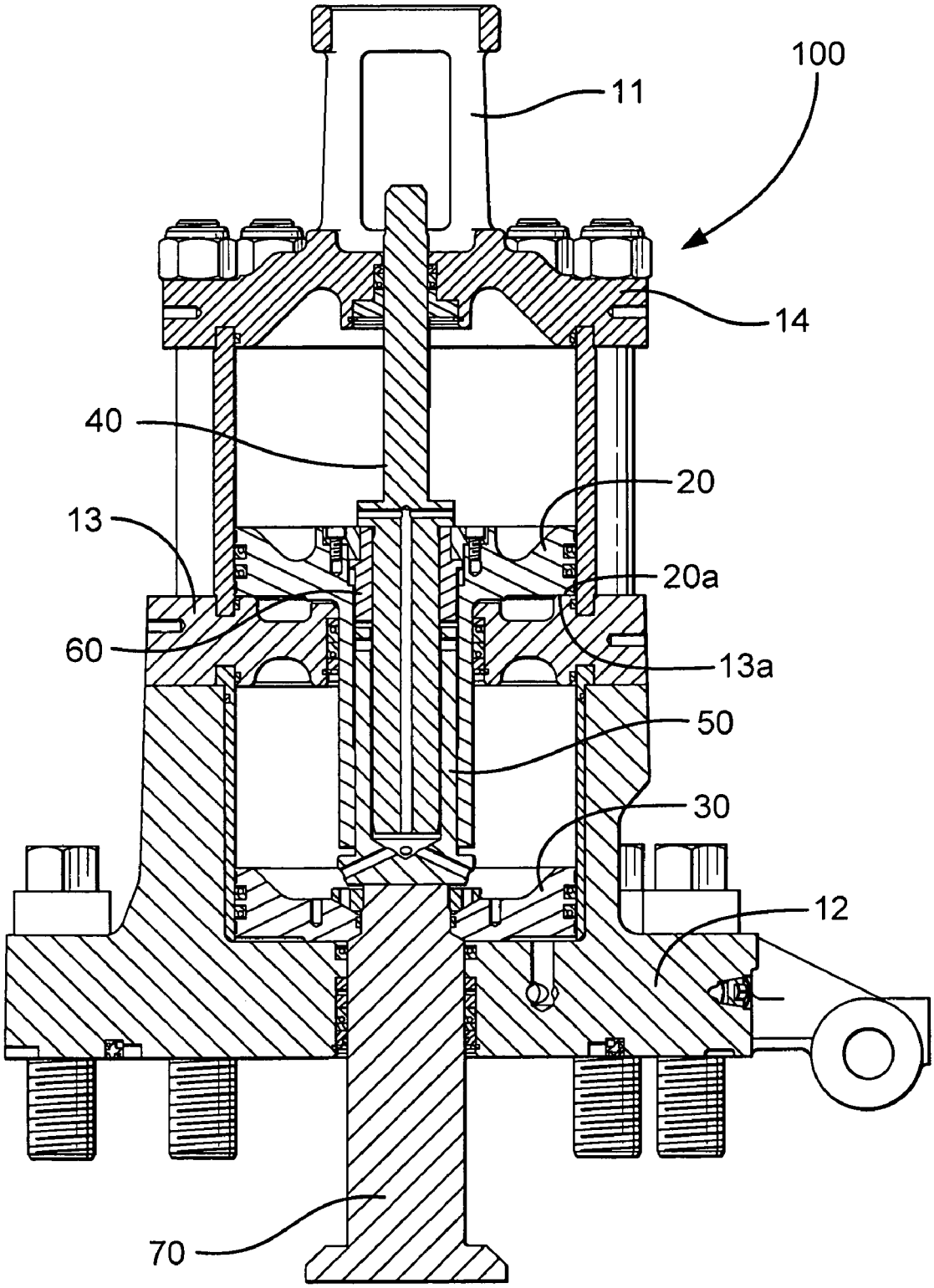

As show in FIG. 2C (cutting of a tubular has been completed) the primary piston 30 has moved its full stroke length, and the booster piston 20 has stopped short due to the contact of a surface 20*a* with a surface 13*k* of moving a distance equal to the length of the full primary piston stroke. The force of the booster piston 20 is thus removed from the ram shaft 70 and the push piston 50 is now free to be moved a distance equal to the length differential between the full stroke length of the primary piston 30 and the stroke length of the booster piston 20.

Figure 2D:
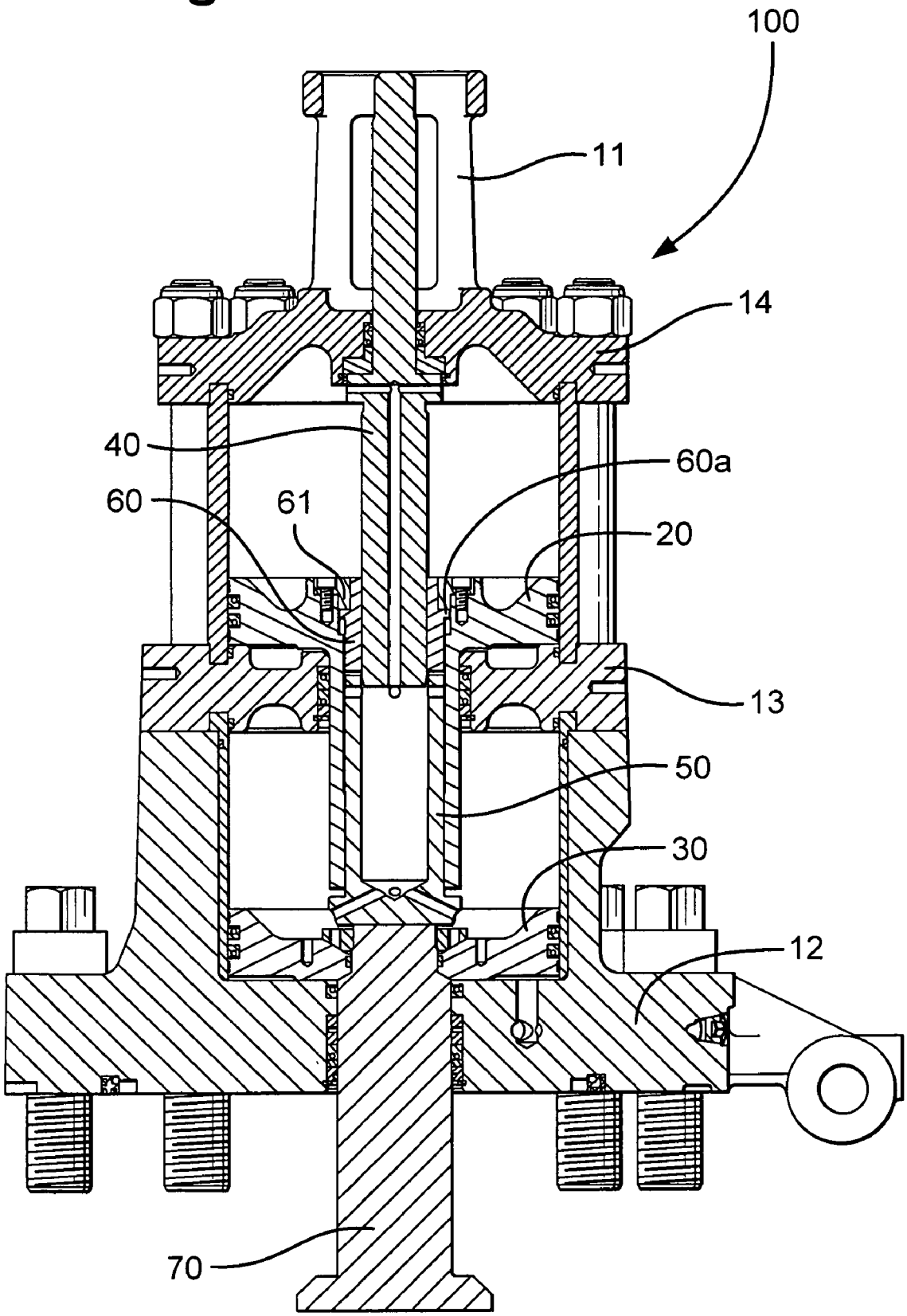

The lock rod 40 and the lock sleeve 60 have mating threads. FIG. 2D illustrates turning of the lock rod 40 within the lock sleeve 60 to a point at which the lock rod 40 has moved to contact the thrust bushing 14*b*.

Figure 2E:
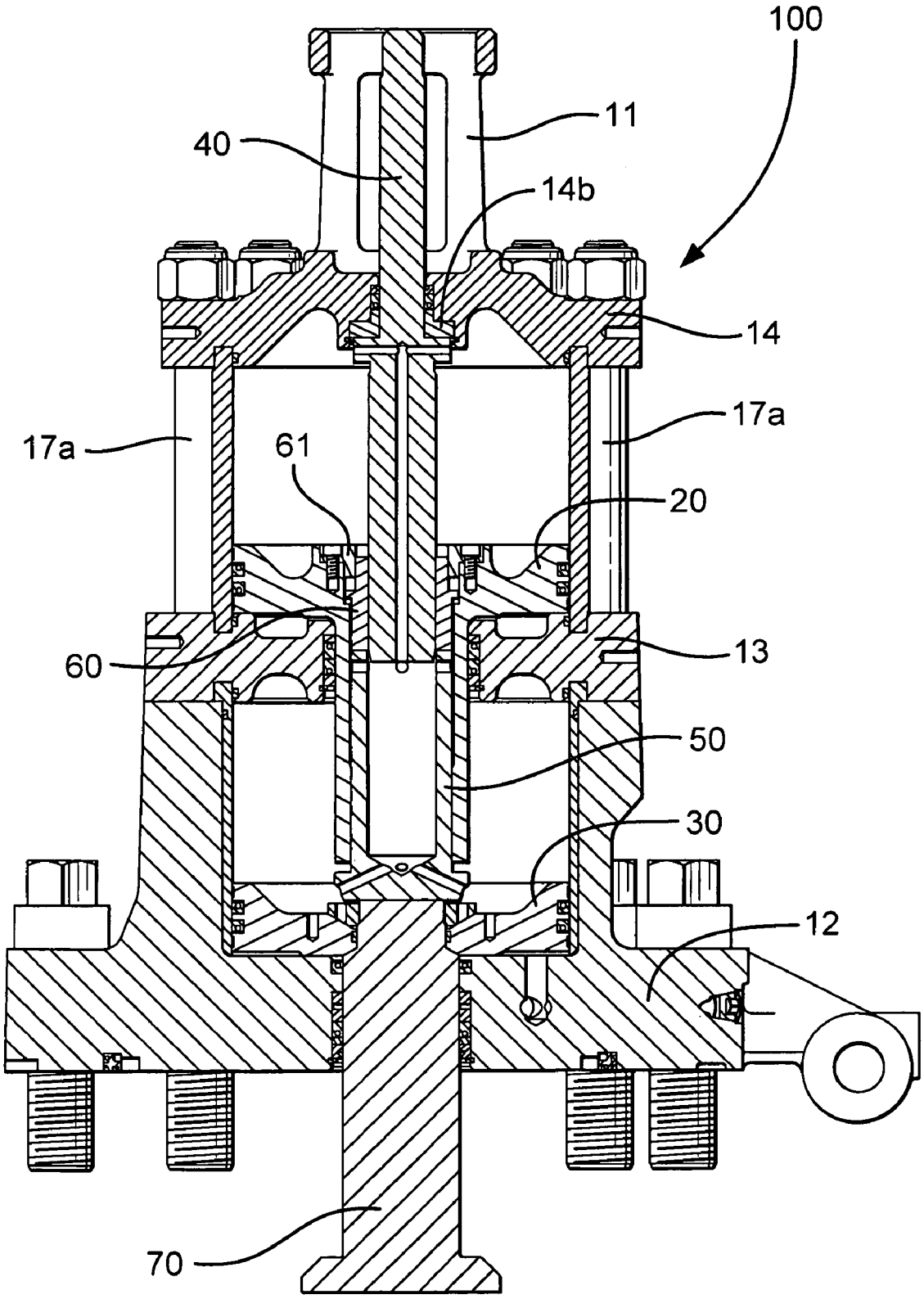

As shown in FIG. 2E the lock rod 40 has continued turning resulting in movement of the lock sleeve 60. The lock sleeve 60 abuts an end of the push piston 50 effecting a solid secure make-up between the ram shaft 70 and the thrust bushing 14*b*. In a ram-closed lock-rod-locked position, the bushing 14*b* takes the load on the lock rod and transfers it to the top plate 14, bolts 17*a*, etc. To unlock the items locked as shown in FIG. 2E, the lock rod 40 is rotated back until it contacts the anti-rotation plate 61. Additional turns move the lock sleeve 60 off the push piston 50, freeing the booster piston 20 for movement away from the middle plate 13.

Figure 2F:
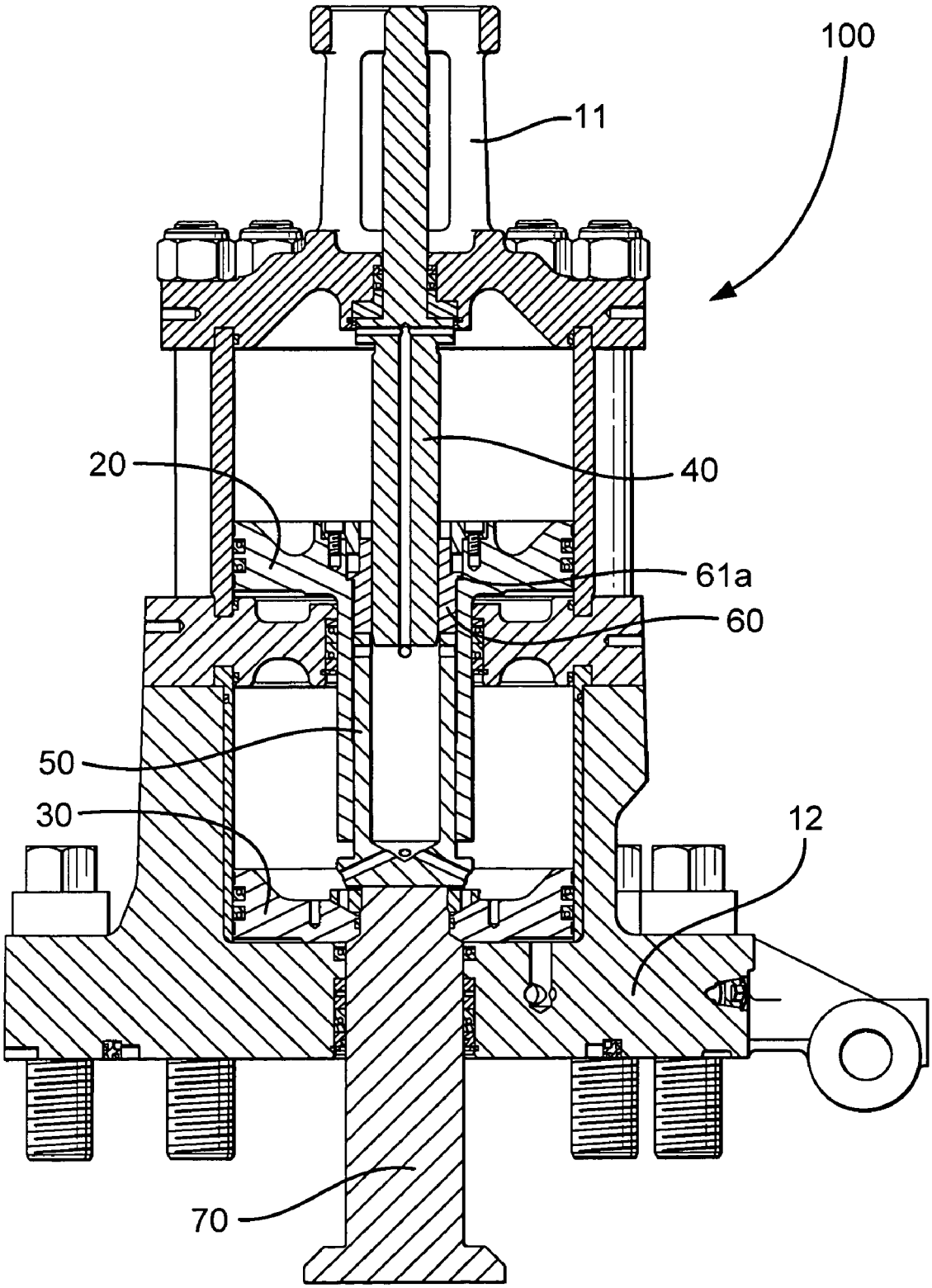

FIG. 2F illustrates that if pressurized fluid is supplied inadvertently to the booster piston 20 when the actuator is in the mechanically locked mode (e.g. someone inadvertently attempts to move the rams to a ram-open position), the booster piston 20 will move to contact the shearable lip 60*a* of the lock sleeve 60, but the booster piston 20 will apply no force to the primary piston 30; and, as pressure is continuously applied to and built up on the booster piston (and to the primary piston), the booster piston shears the shearable lip taking the load off the lock rod 40.

Figure 2G:
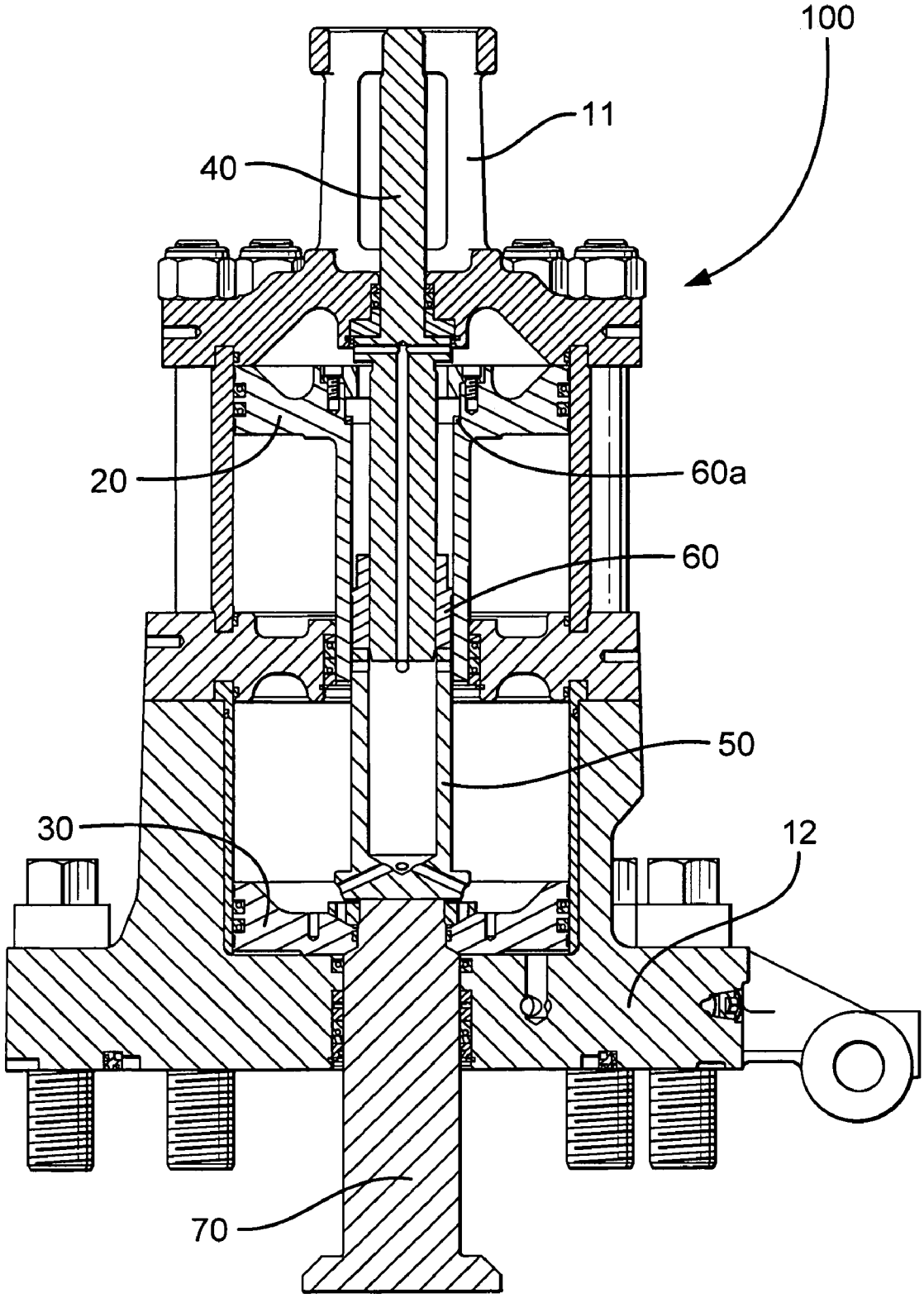

FIG. 2G illustrates that the additive force of both pistons 20, 30 is prevented from being applied to the lock rod 40 since shearing of the restraining lip 60*a* of the lock sleeve 60 by the booster piston 20 allows the booster piston 20 to move away from the primary piston 30 to its initial (ram-open) position, thereby eliminating the force of the booster piston 20 against the lock rod 40. The lip 60*a* is optional.

Figure 3A:
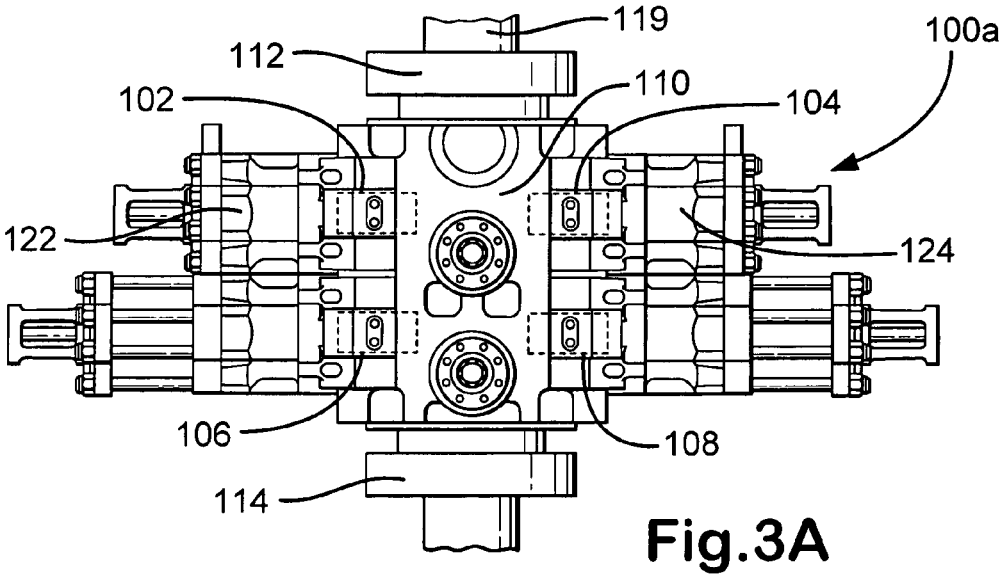
FIG. 3A is a side view of a blowout preventer according to the present invention.

FIG. 3A shows a blowout preventer 100*a* according to the present invention with a main body 110 with upper shear ram apparatuses 102, 104 (each like ram apparatuses according to the present invention described above and, in certain aspects, as shown in FIG. 1A or 2A) and with lower rams 106, 108 (like any suitable rams disclosed in the prior art). The body 110 has upper and lower flanges 112, 114, and a central bore 116 therethrough through which selectively extends a tubular 119.

Figure 3B:
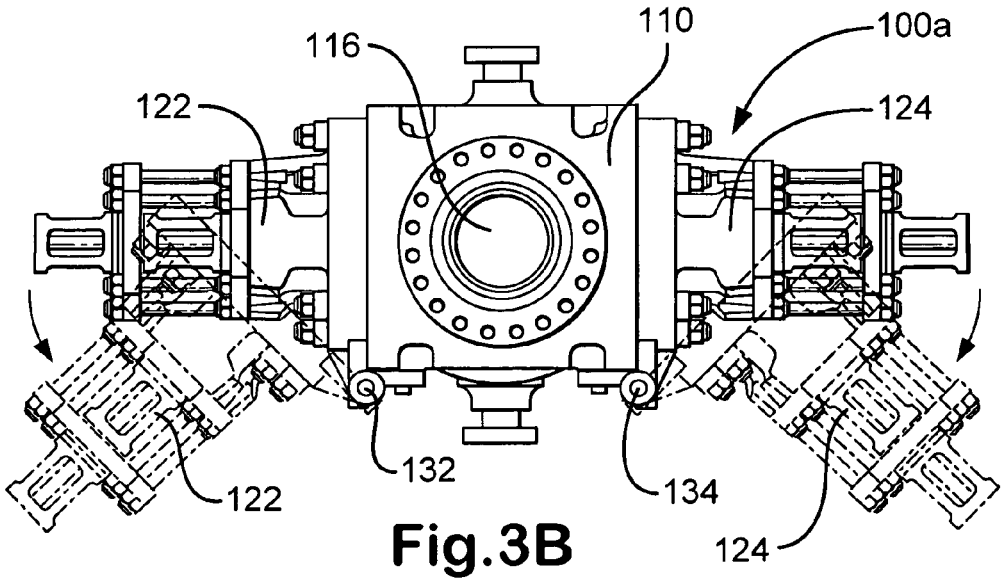
FIG. 3B is a top view of the blowout preventer of FIG. 3A.

As shown in FIG. 3B in dotted line, bonnets 122, 124 of the ram apparatuses 102, 104, respectively, may be hingedly connected to the main body 110 with hinge apparatus 132, 134, respectively.

In one particular comparison, comparing a prior art commercially available Shaffer 1310 SL Blowout Preventer with a 14 square inch primary piston and a 16 square inch booster piston to a blowout preventer according to the present invention with a 15¼ inch diameter and a 182.6 square inch area primary piston and a 15¼ inch diameter 179.6 square inch area booster piston (with an effective total piston area of about 355 square inches), the force applied by each blowout preventer to a ram shaft is either about the same or the new system's force is slightly larger; e.g., with one particular embodiment of the new system according to the present invention, the blowout preventer is about two feet (or about thirty percent) shorter; each piston has a diameter of about 15¼ inches and there is total effective piston area of about 360 square inches so the developed force is slightly larger than that developed with the old system. In one particular embodiment of the new system according to the present invention, part of the apparatus is moved into the door. Also in the new system the lock rod does not extend through the primary piston and is not connected to the ram shaft as in the old system; and in the new system the force of the booster piston can be removed from the ram shaft while the force of the primary piston is still applied to the ram shaft.

Figure 4:
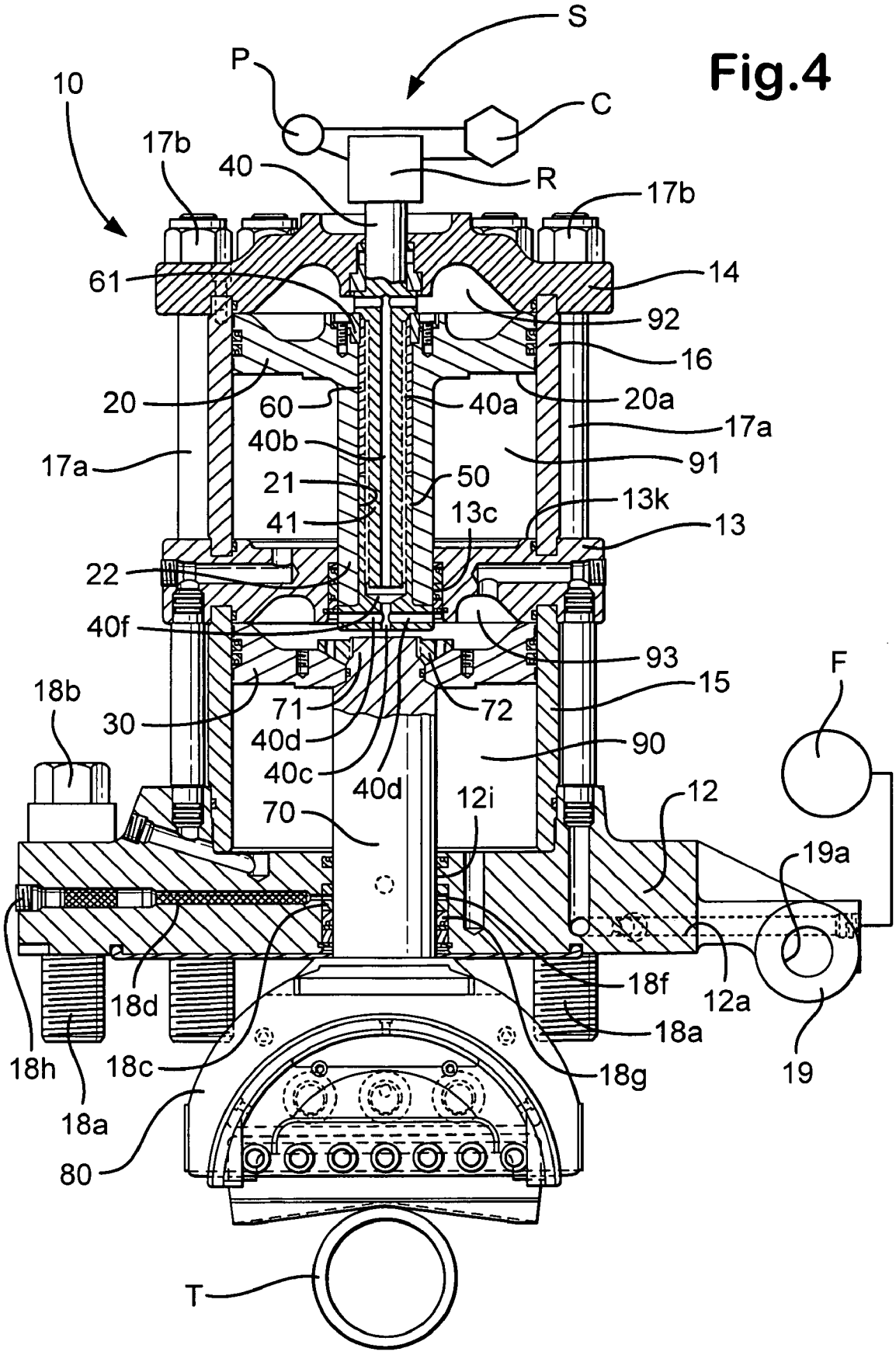
FIG. 4 shows an actuator, like that of FIG. 1, with automatic operating apparatus.

FIG. 4 shows a blowout preventer like the blowout preventer 10 of FIG. 1 and like numerals indicate like parts. An automatic system S automatically controls rotation of the lock rod 40 and, thereby, automatically controls the selectively locking of the pistons and the release of the booster piston's force. The system S has rotation apparatus R connected to lock rod 40. The rotation apparatus R is controlled by a control system C and is powered (electrical, pneumatic, or hydraulic) by a power system P which is also controlled by the control system R. As may be the case for the blowout preventer as shown in FIG. 1, power fluid is provided to the blowout preventer from a power fluid source F.

The present invention provides, in certain embodiments, a blowout preventer with a main body, a base releasably connected to the main body, the base having a base space therein, the base having a ram shaft opening, a primary piston movably disposed within the base space, a ram shaft to which the primary piston is connected, the ram shaft including a ram end and a piston end, a ram connected to the ram end of the ram shaft, a housing connected to the base, the housing having a housing space therein, the housing including a middle member with a member opening, a booster piston movably disposed within the housing space, the booster piston including a booster shaft projecting therefrom, the booster shaft movable within the member opening, the booster shaft having a booster shaft space therein, the shaft including a push portion with part thereof within the booster shaft space, the push portion including an end portion movable with the booster piston to abut the piston end of the ram shaft to prevent movement of the ram shaft, the push portion positioned for transferring force of the booster piston to the primary piston upon abutment of the end portion with the piston end of the ram shaft, and fluid channel apparatus for directing power fluid to and from the primary piston and the booster piston. Such a blowout preventer may have one or some, in any possible combination, of the following: the blowout preventer locking apparatus within the booster shaft space for selectively holding the push portion against the ram shaft so that the combination of forces of force of the booster piston and force of the primary piston is maintained on the ram; wherein the push portion includes a push piston movably disposed within the booster shaft space, the push piston having a push piston end movable to abut the piston end of the ram shaft; wherein the locking apparatus includes a lock rod with a lock rod portion movably disposed within the push piston; wherein the booster piston has a piston surface and the middle member having an abutment surface located such that said abutment surface contacts said piston surface when the booster piston reaches a limit of its stroke; wherein, upon contact of the abutment surface with the piston surface, the locking sleeve is movable to move the push piston into contact with the piston end of the ram shaft so that force transfer between the booster piston and the primary piston is maintained; wherein the lock rod is selectively rotatable to remove the force of the booster piston from the primary piston following selected action by the ram by backing off the push piston from the piston end of the ram shaft; wherein a portion of the lock rod projects out from the housing and is manually rotatable with a suitable tool; a lock sleeve disposed above the push piston in the booster shaft space, the lock sleeve having a shearable lip projecting outwardly therefrom, said lip shearable against a part of the booster piston in response to force applied to the lock sleeve by the booster piston thereby permitting movement of the booster piston so that a force applied by the booster piston through the lock rod to the ram shaft is no longer applied to the ram shaft; wherein the lock rod is connected to automatic lock rod rotation apparatus which automatically rotates the lock rod, the automatic lock rod rotation apparatus including a control system for controlling said rotation and a power system for providing power for said rotation; wherein the push piston is selectively movable so that force of the booster piston is selectively removable from the primary piston; and/or flow channel apparatus within the push piston for conducting power fluid to the booster piston so that the booster piston and the primary piston move simultaneously.

The present invention provides, in certain embodiments, a blowout preventer with a main body; a base releasably connected to the main body, the base having a base space therein, the base having a ram shaft opening; a primary piston movably disposed within the base space; a ram shaft to which the primary piston is connected, the ram shaft including a ram end and a piston end; a ram connected to the ram end of the ram shaft; a housing connected to the base, the housing having a housing space therein, the housing including a middle member with a member opening; a booster piston movably disposed within the housing space, the booster piston including a booster shaft projecting therefrom, the booster shaft movable within the member opening, the booster shaft having a booster shaft space therein; the primary piston and the booster piston movably disposed for applying force to the ram shaft; a free floating push piston movably disposed in the booster shaft space; selective lock apparatus for selectively contacting the free floating push piston to selectively transfer force of the booster piston to the ram shaft and to selectively isolate the ram shaft from the booster piston; and fluid channel apparatus for directing power fluid to and from the primary piston and the booster piston.

The present invention provides, in certain embodiments, a method for operating a blowout preventer, the method including rotating a lock rod of a blowout preventer to lock a ram shaft in position, the blowout preventer like any blowout preventer disclosed herein with a lock rod.

In conclusion, therefore, it is seen that the present invention and the embodiments disclosed herein and those covered by the appended claims are well adapted to carry out the objectives and obtain the ends set forth. Certain changes can be made in the subject matter described, shown and claimed without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A blowout preventer comprising a main body, a base releasably connected to the main body, the base having a base space therein, the base having a ram shaft opening, a primary piston movably disposed within the base space, a ram shaft to which the primary piston is connected, the ram shaft including a ram end and a piston end, a ram connected to the ram end of the ram shaft, a housing connected to the base, the housing having a housing space therein, the housing including a middle member with a member opening, a booster piston movably disposed within the housing space, the booster piston including a booster shaft projecting therefrom, the booster shaft movable within the member opening, the booster shaft having a booster shaft space therein, the shaft including a push portion with part thereof within the booster shaft space, the push portion including an end portion movable with the booster piston to abut the piston end of the ram shaft to prevent movement of the ram shaft, the push portion positioned for transferring force of the booster piston to the primary piston upon abutment of the end portion with the piston end of the ram shaft, and fluid channel apparatus for directing power fluid to and from the primary piston and the booster piston.

2. The blowout preventer of claim 1 further comprising locking apparatus within the booster shaft space for selectively holding the push portion against the ram shaft so that the combination of forces of force of the booster piston and force of the primary piston is maintained on the ram.

3. The blowout preventer of claim 1 wherein the push portion includes a push piston movably disposed within the booster shaft space, the push piston having a push piston end movable to abut the piston end of the ram shaft.

4. The blowout preventer of claim 2 wherein the locking apparatus includes a lock rod with a lock rod portion movably disposed within the push piston.

5. The blowout preventer of claim 4 wherein the booster piston has a piston surface and the middle member having an abutment surface located such that said abutment surface contacts said piston surface when the booster piston reaches a limit of its stroke.

6. The blowout preventer of claim 5 wherein, upon contact of the abutment surface with the piston surface, the locking sleeve is movable to move the push piston into contact with the piston end of the ram shaft so that force transfer between the booster piston and the primary piston is maintained.

7. The blowout preventer of claim 6 wherein the lock rod is selectively rotatable to remove the force of the booster piston from the primary piston following selected action by the ram by backing off the push piston from the piston end of the ram shaft.

8. The blowout preventer of claim 4 wherein a portion of the lock rod projects out from the housing and is manually rotatable with a suitable tool.

9. The blowout preventer of claim 7 further comprising a lock sleeve disposed above the push piston in the booster shaft space, the lock sleeve having a shearable lip projecting outwardly therefrom, said lip shearable against a part of the booster piston in response to force applied to the lock sleeve by the booster piston thereby permitting movement of the booster piston so that a force applied by the booster piston through the lock rod to the ram shaft is no longer applied to the ram shaft.

10. The blowout preventer of claim 4 wherein the lock rod is connected to automatic lock rod rotation apparatus which automatically rotates the lock rod, the automatic lock rod rotation apparatus including a control system for controlling said rotation and a power system for providing power for said rotation.

11. The blowout preventer of claim 4 wherein the push piston is selectively movable so that force of the booster piston is selectively removable from the primary piston.

12. The blowout preventer of claim 1 further comprising flow channel apparatus within the push piston for conducting power fluid to the booster piston so that the booster piston and the primary piston move simultaneously.

13. A blowout preventer comprising a main body, a base releasably connected to the main body, the base having a base space therein, the base having a ram shaft opening, a primary piston movably disposed within the base space, a ram shaft to which the primary piston is connected, the ram shaft including a ram end and a piston end, a ram connected to the ram end of the ram shaft, a housing connected to the base, the housing having a housing space therein, the housing including a middle member with a member opening, a booster piston movably disposed within the housing space, the booster piston including a booster shaft projecting therefrom, the booster shaft movable within the member opening, the booster shaft having a booster shaft space therein, the primary piston and the booster piston movably disposed for applying force to the ram shaft, a free floating push piston movably disposed in the booster shaft space, selective lock apparatus for selectively contacting the free floating push piston to selectively transfer force of the booster piston to the ram shaft and to selectively isolate the ram shaft from the booster piston, and fluid channel apparatus for directing power fluid to and from the primary piston and the booster piston.

14. A blowout preventer comprising a main body, a base releasably connected to the main body, the base having a base space therein, the base having a ram shaft opening, a primary piston movably disposed within the base space, a ram shaft to which the primary piston is connected, the ram shaft including a ram end and a piston end, a ram connected to the ram end of the ram shaft, a housing connected to the base, the housing having a housing space therein, the housing including a middle member with a member opening, a booster piston movably disposed within the housing space, the booster piston including a booster shaft projecting therefrom, the booster shaft movable within the member opening, the booster shaft having a booster shaft space therein, the shaft including a push portion with part thereof within the booster shaft space, the push portion including an end portion movable with the booster piston to abut the piston end of the ram shaft to prevent movement of the ram shaft, the push portion positioned for transferring force of the booster piston to the primary piston upon abutment of the end portion with the piston end of the ram shaft, and fluid channel apparatus for directing power fluid to and from the primary piston and the booster piston, locking apparatus within the booster shaft space for selectively holding the push portion against the ram shaft so that the combination of forces of force of the booster piston and force of the primary piston is maintained on the ram, wherein the push portion includes a push piston movably disposed within and freely floating within the booster shaft space, the push piston having a push piston end movable to abut the piston end of the ram shaft, wherein the locking apparatus includes a lock rod with a lock rod portion movably disposed within the push piston, wherein the booster piston has a piston surface and the middle member having an abutment surface located such that said abutment surface contacts said piston surface when the booster piston reaches a limit of its stroke, wherein,, upon contact of the abutment surface with the piston surface, the locking sleeve is movable to move the push piston into contact with the piston end of the ram shaft so that force transfer between the booster piston and the primary piston is maintained, and wherein the lock rod is selectively rotatable to remove the force of the booster piston from the primary piston following selected action by the ram by backing off the push piston from the piston end of the ram shaft.

15. The blowout preventer of claim 4 wherein a portion of the lock rod projects out from the housing and is manually rotatable with a suitable tool, and the blowout preventer further comprises a lock sleeve disposed above the push piston in the booster shaft space, the lock sleeve having a shearable lip projecting outwardly therefrom, said lip shearable against a part of the booster piston in response to force applied to the lock sleeve by the booster piston thereby permitting movement of the booster piston so that a force applied by the booster piston through the lock rod to the ram shaft is no longer applied to the ram shaft.

16. A method for operating a blowout preventer, the method comprising rotating a lock rod of a blowout preventer to lock a ram shaft in position, the blowout preventer comprising a main body, a base releasably connected to the main body, the base having a base space therein, the base having a ram shaft opening, a primary piston movably disposed within the base space, a ram shaft to which the primary piston is connected, the ram shaft including a ram end and a piston end, a ram connected to the ram end of the ram shaft, a housing connected to the base, the housing having a housing space therein, the housing including a middle member with a member opening, a booster piston movably disposed within the housing space, the booster piston including a booster shaft projecting therefrom, the booster shaft movable within the member opening, the booster shaft having a booster shaft space therein, the shaft including a push portion with part thereof within the booster shaft space, the push portion including an end portion movable with the booster piston to abut the piston end of the ram shaft to prevent movement of the ram shaft, the push portion positioned for transferring force of the booster piston to the primary piston upon abutment of the end portion with the piston end of the ram shaft, fluid channel apparatus for directing power fluid to and from the primary piston and the booster piston, locking apparatus within the booster shaft space for selectively holding the push portion against the ram shaft so that the combination of forces of force of the booster piston and force of the primary piston is maintained on the ram, wherein the push portion includes a push piston movably disposed within the booster shaft space, the push piston having a push piston end movable to abut the piston end of the ram shaft, and wherein the locking apparatus includes a lock rod with a lock rod portion movably disposed within the push piston.

17. The method of claim 16 wherein the blowout preventer includes the booster piston having a piston surface and the middle member having an abutment surface located such that said abutment surface contacts said piston surface when the booster piston reaches a limit of its stroke, and upon contact of the abutment surface with the piston surface the push piston moves to contact with the piston end of the ram shaft so that force transfer between the booster piston and the primary piston is maintained, the method further comprising rotating the lock rod to move the push piston so that the push piston contacts the piston end of the ram shaft, thereby maintaining force transfer between the booster piston and the primary piston.

18. The method of claim 17 wherein the blowout preventer includes lock rod selectively rotatable to remove the force of the booster piston from the primary piston following selected action by the ram by backing off the push piston from the piston end of the ram shaft, the method further comprising rotating the lock rod to remove the force of the booster piston from the primary piston.

19. The method of claim 16 wherein a lock sleeve is disposed above the push piston in the booster shaft space, the lock sleeve having a shearable lip projecting outwardly therefrom, said lip shearable against a part of the booster piston in response to force applied to the lock sleeve by the booster piston thereby permitting movement of the booster piston to remove force applied by the booster piston through the lock rod to the ram shaft, the method further comprising shearing the shearable lip, and removing the booster piston force from the primary piston.

20. The method of claim 16 wherein the push piston is selectively movable so that force of the booster piston is selectively removable from the primary piston, the method further comprising selectively moving the push piston to remove the booster piston force from the primary piston.

* * * * *